US005615757A

United States Patent [19]

Chen

[11] Patent Number: 5,615,757

[45] Date of Patent: Apr. 1, 1997

[54] RETRACTABLE HANDLE ASSEMBLY FOR A SUITCASE

[76] Inventor: Hsiung-chih Chen, No. 428, Tung-an Rd., Wenchu Li, Tachia Chen, Taichung Hsien, Taiwan

[21] Appl. No.: 544,485

[22] Filed: Oct. 18, 1995

[51] Int. Cl.[6] ..... A45C 13/26

[52] U.S. Cl. ..... 190/115; 16/112; 16/115

[58] Field of Search ..... 190/18 A, 115; 16/112, 115; 280/47.315, 47.371

[56] References Cited

U.S. PATENT DOCUMENTS

| | | | |
|---|---|---|---|
| 2,392,926 | 1/1946 | Kelly | 190/115 |
| 4,299,313 | 11/1981 | Null | 16/115 X |
| 4,358,005 | 11/1982 | Fontana | 190/115 X |
| 4,561,526 | 12/1985 | Winter et al. | 190/18 A X |
| 5,075,925 | 12/1991 | Maloney | 280/47.371 |
| 5,330,037 | 7/1994 | Wang | 190/18 A |
| 5,339,934 | 8/1994 | Liang | 190/115 X |
| 5,394,965 | 3/1995 | Kho | 190/115 |
| 5,464,080 | 11/1995 | Liang | 190/18 A |
| 5,547,053 | 8/1996 | Liang | 16/115 X |

*Primary Examiner*—Allan N. Shoap
*Assistant Examiner*—Christopher J. McDonald
*Attorney, Agent, or Firm*—Parkhurst, Wendel & Burr, L.L.P.

[57] ABSTRACT

A retractable handle assembly is provided for a side plate of a suitcase and includes an outer casing having a lower portion pivotally mounted to a lower portion of the side plate. A lug is formed on the outer casing and has a chamber defined therein. A horizontal post is formed on the side plate and a biasing member is urged between the horizontal post and the lug. Two retaining blocks are each formed on an upper portion of the side plate and each has a guiding groove vertically defined therein. A linking member includes a first axle pivotally attached to an upper portion of the outer casing and a second axle having two distal ends each being stopped by a corresponding one of the two retaining blocks and each being slidable in an associated guiding groove. An inner casing is slidably mounted in the outer casing. An elongated handle is slidably mounted in the inner casing and has an upper end portion fixedly engaged with a handgrip which has a hole defined therethrough and further has a slot defined in a lower portion thereof. A resilient knob is formed on the upper portion of the side plate and is received in the hole. A stop block is formed on an underside of the resilient knob and is detachably engaged in the slot of the handgrip.

6 Claims, 9 Drawing Sheets

RETRACTABLE HANDLE ASSEMBLY FOR A SUITCASE

BACKGROUND OF THE INVENTION

1. Field of the Invention

The present invention relates to a handle assembly, and more particularly to a retractable handle assembly for a suitcase.

2. Related Prior Art

A conventional retractable handle assembly is mounted on an underside of a suitcase and is not easily operated, so incurring an inconvenience for passengers.

The present invention has arisen to mitigate and/or obviate disadvantages of the conventional handle assembly.

SUMMARY OF THE INVENTION

The primary objective of the present invention is to provide a retractable handle assembly which can be expanded and folded easily.

In accordance with one aspect of the present invention, there is provided a retractable handle assembly for a suitcase which includes a side plate securely mounted thereon. The retractable handle assembly comprises an elongated outer casing having a lower portion pivotally mounted to a lower portion of the side plate and having a first passage longitudinally defined therein.

A lug is laterally formed on a mediate portion of the outer casing and protrudes outwardly therefrom and includes a chamber transversely defined therein. A horizontal post is laterally formed on a mediate portion of the side plate and is detachably engaged in the cheer of the lug. A biasing member is mounted in the chamber and is urged between the horizontal post and the lug.

Two retaining blocks are each laterally formed on an upper portion of the side plate and protrude outwardly therefrom and each have a guiding groove vertically defined therein. A linking member includes a first axle pivotally attached to an upper portion of the outer casing and a second axle having two distal ends each being stopped by a corresponding one of the two retaining blocks and each being slidable in an associated guiding groove.

An elongated inner casing is slidably mounted in the first passage of the outer casing and has a second passage longitudinally defined therein. An elongated handle is slidably mounted in the second passage of the inner casing and has an upper end portion extending outward of the upper portion of the inner and outer casings. A handgrip has a lower portion fixedly attached to the upper end portion of the elongated handle and has a hole transversely defined therethrough. A slot is defined in the lower portion of the handgrip and communicates with the hole.

A resilient knob is laterally formed on the upper portion of the side plate located above the two retaining blocks and is received in the hole of the handgrip. A stop block is formed on an underside of the resilient knob and is detachably engaged in the slot of the handgrip.

Further objectives and advantages of the present invention will become apparent from a careful reading of the detailed description provided hereinbelow, with appropriate reference to the accompanying drawings.

DETAILED DESCRIPTION OF THE EMBODIMENTS

Figure 1:
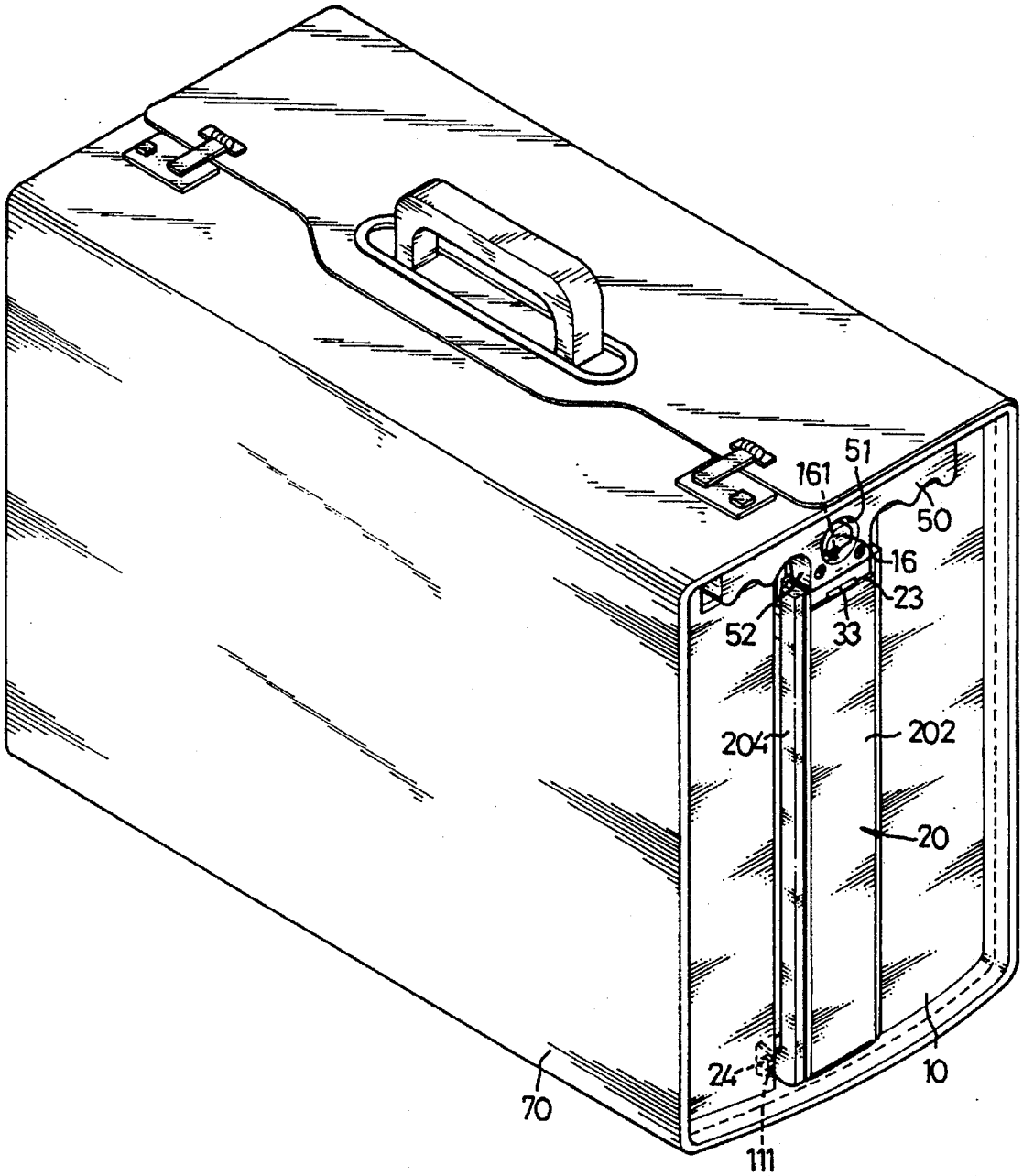
FIG. 1 is a perspective view of a handle assembly for a suitcase in accordance with the present invention.
Figure 2:
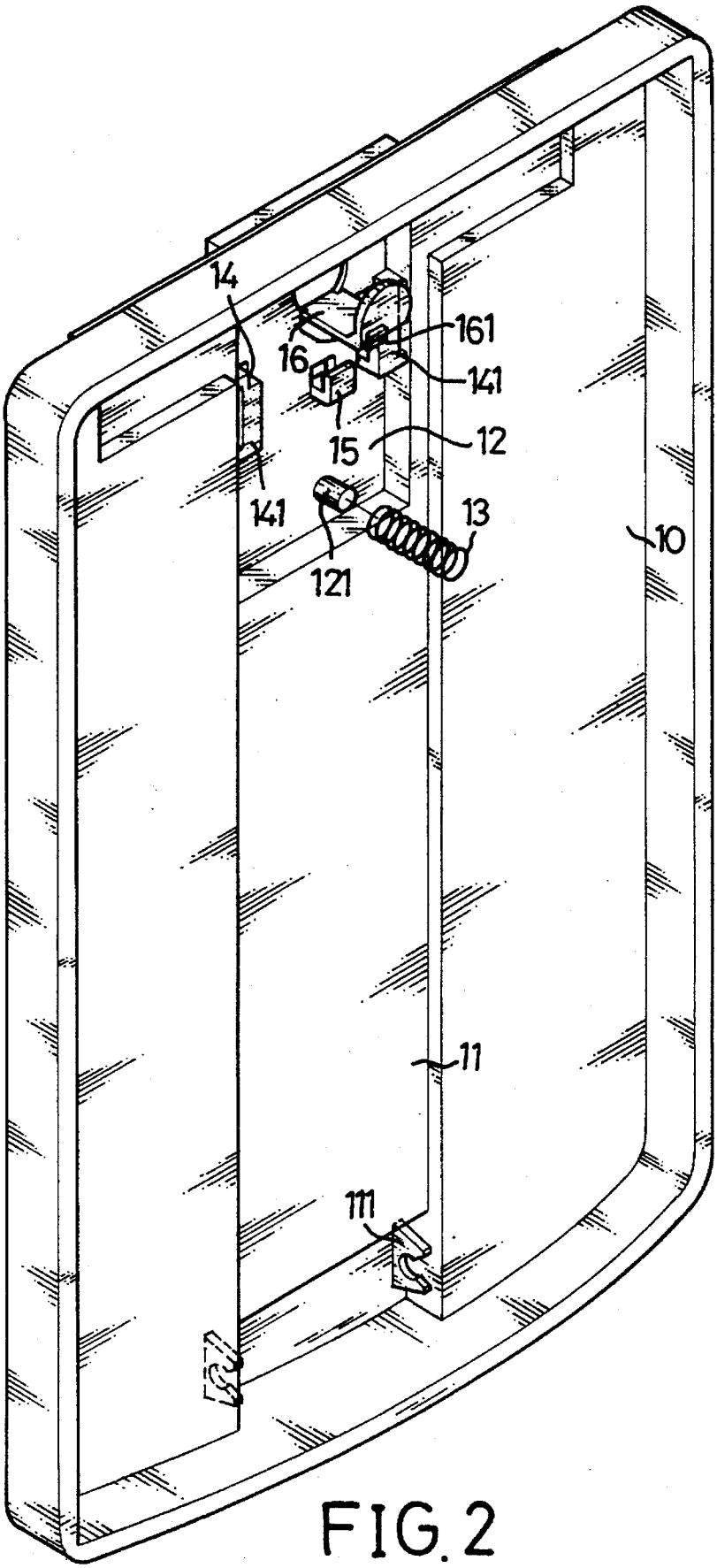
FIG. 2 is a perspective view showing a structure of a side plate.
Figure 3:
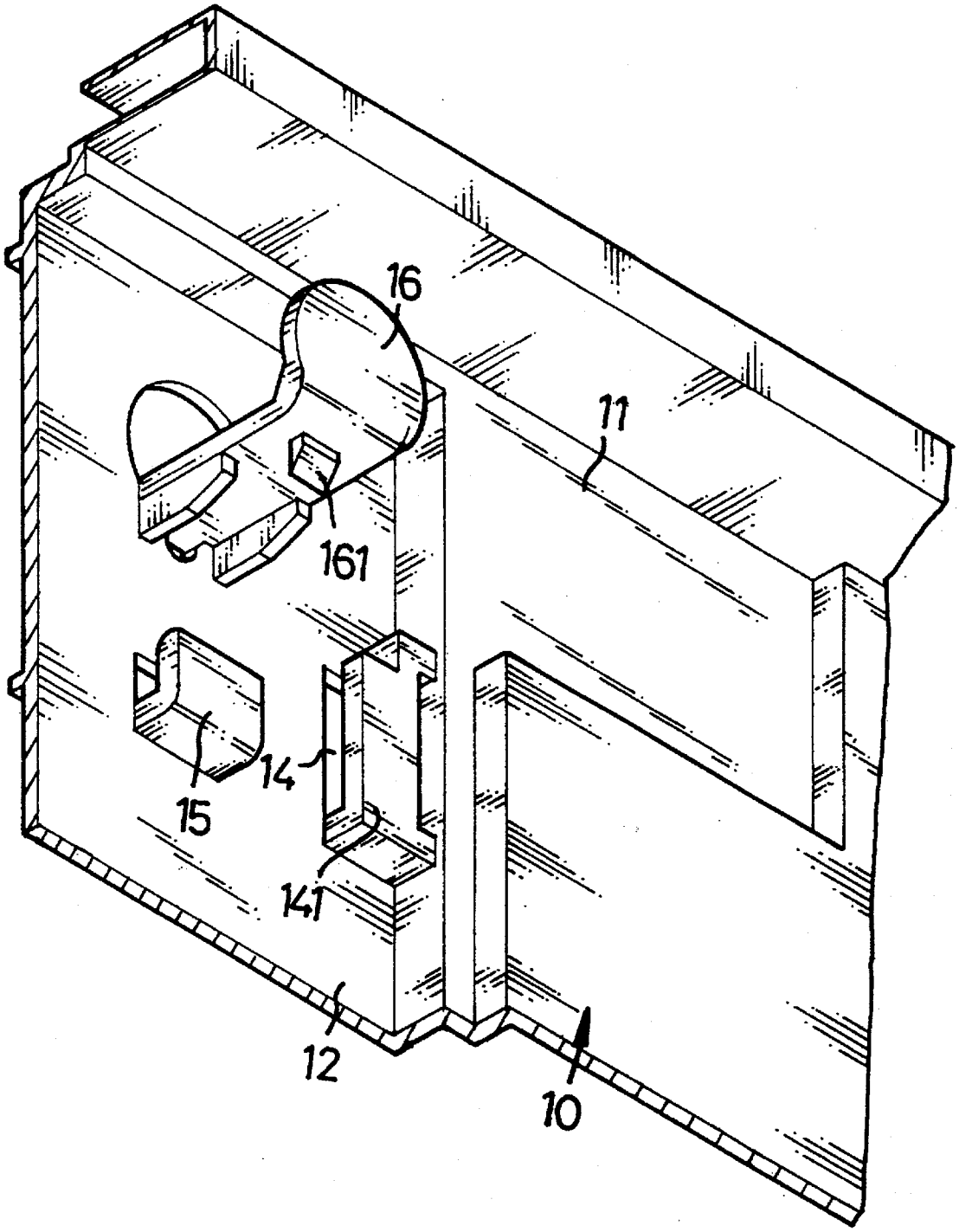
FIG. 3 is a partially enlarged view of FIG. 2.
Figure 4:
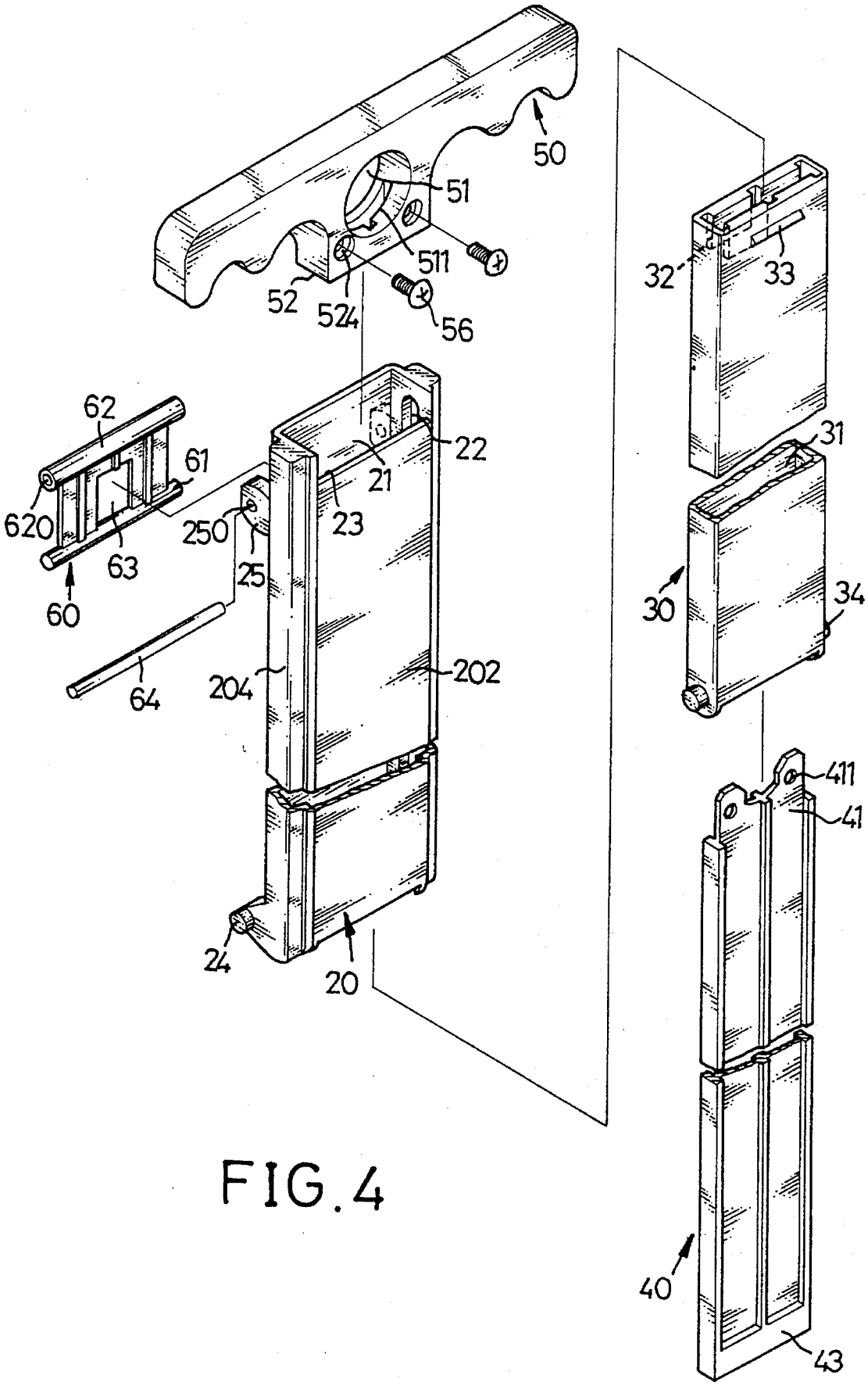
FIG. 4 is a perspective exploded view of the handle assembly.
Figure 5:
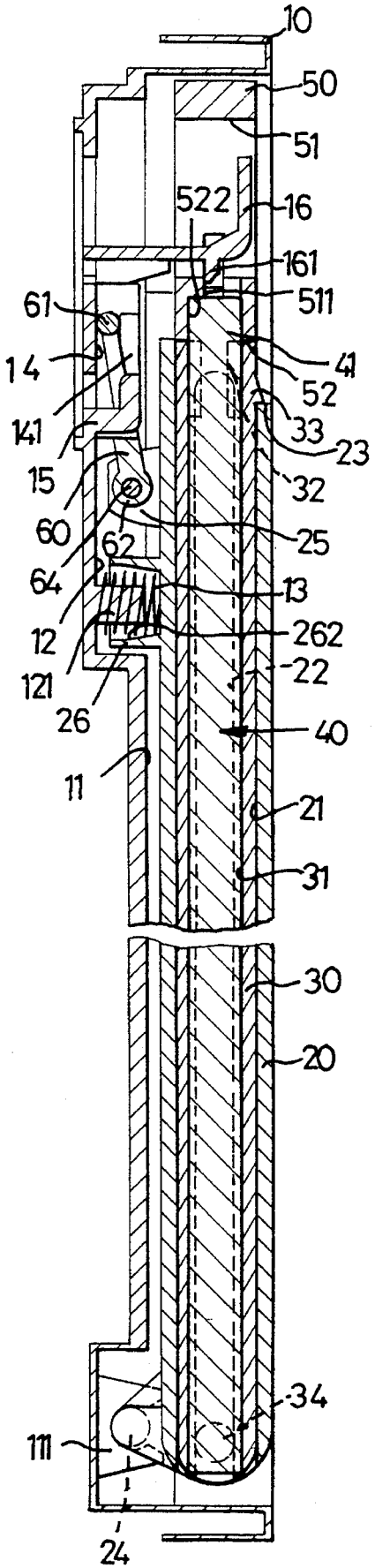
FIG. 5 is a side cross-sectional assembly view of FIG. 4.

Referring to the drawings, and initially to FIGS. 4 and 5 with reference to FIGS. 1–3, a retractable handle assembly in accordance with the present invention is provided for a suitcase 70 having a side plate 10 securely mounted thereon which includes an upper portion, a mediate portion and a lower portion. A substantially T-shaped depression 11 is defined in the side plate 10 and a substantially rectangular recess 12 is defined in the upper portion of the side plate 10. The recess 12 communicates with and has depth greater than that of the depression 11.

There are two positioning ears 111 each formed on the lower portion of the side plate 10. Preferably, a plurality of wheels (not shown) are respectively mounted on an underside of the suitcase 70.

The retractable handle assembly comprises an elongated outer casing (or tube) 20 mounted in the depression 11 of the side plate 10. The outer casing 20 includes an upper portion, a mediate portion and a lower portion, and has a first passage 21 longitudinally defined therein. There are two stubs 24 each laterally formed on and protruding outwardly from the lower portion of the outer casing 20 and each rotatably engaged in a corresponding one of the two positioning ears 111 such that the lower portion of the outer casing 20 is pivotally mounted to the lower portion of the side plate 10.

There are two retaining blocks 141 each laterally formed on the upper portion of the side plate 10 located in the recess 12 and protruding outwardly therefrom and each having a guiding groove 14 vertically defined therein. Preferably, an L-shaped hook member 15 includes a horizontal section formed on the upper portion of the side plate 10 and located between the two retaining blocks 141 and a vertical section extending upwardly.

A linking member 60 is pivotally engaged between the upper portion of the outer casing 20 and the two retaining blocks 141 and includes a first axle 62 pivotally attached to the upper portion of the outer casing 20 and a second axle 61 having two distal ends each being stopped by a corresponding one of the two retaining blocks 141 and each being slidable in an associated guiding groove 14. An opening 63 is defined in the linking member 60 and is located between the first and second axles 62 and 61.

Preferably, there are two positioning ears 25 each formed on the upper portion of the outer casing 20 and each having a bore 250 transversely defined therethrough. The first axle 62 of the linking member 60 is mounted between the two positioning ears 25 and includes a through hole 620 longitudinally defined therein and aligning with the two bores 250. A positioning pin 64 extends through the two bores 250 and the through hole 620 such that the linking member 60 is pivoted to the outer casing 20 about the first axle 62.

A lug 26 (see FIG. 5) is laterally formed on the mediate portion of the outer casing 20 and protrudes outwardly therefrom and has a chamber 262 transversely defined therein. A horizontal post 121 (see FIGS. 2 and 5) is laterally formed on the mediate portion of the side plate 10 and is detachably disposed in the chamber 262 of the lug 26. A biasing member 13, such as a spring, is mounted in the chamber 262 and is urged between the horizontal post 121 and the lug 26.

An elongated inner casing 30 (or tube) is slidably mounted in the first passage 21 of the outer casing 20 and has a second passage 31 longitudinally defined therein.

Preferably, the outer casing 20 includes two longer walls 202 and two shorter walls 204. Each of the two shorter walls 204 has an elongated slot 22 longitudinally defined therein and communicating with the first passage 21. Two stubs 34 are each laterally formed on a lower portion of the inner casing 30 and each is slidably mounted in a corresponding one of the two elongated slots 22.

In addition, one of the two longer walls 202 includes an upper edge 23 having a level lower than that of an uppermost part of each of the two elongated slots 22. A projection 33 is laterally formed on the upper portion of the inner casing 30 and detachably abuts an upperside of the upper edge 23.

An elongated handle 40 is slidably mounted in the second passage 31 of the inner casing 30 and has an upper end portion 41 extending outward of the upper portion of the inner and outer casings 30 and 20.

Preferably, a first flange 43 is formed on a lower end portion of the elongated handle 40, and a second flange 32 is formed on the upper portion of the inner casing 30 and extends inwardly from a perimeter of the second passage 31 for stopping movement of the first flange 43, thereby preventing the handle 40 from being detached from the inner casing 30.

A handgrip 50 has a lower portion 52 fixedly attached to the upper end portion 41 of the elongated handle 40. Preferably, an opening 522 (see FIG. 5) is defined in an underside of the lower portion 52 of the hand gripper 50 for receiving the upper end portion 41 of the handle 40 therein. At least one screw 56 extends through a threaded hole 524 defined in the lower portion 52 of the hand gripper 50 and through a hole 411 defined in the upper end portion 41 of the handle 40, thereby securing the hand gripper 50 to the handle 40.

A hole 51 is transversely defined through the hand gripper 50, and a slot 511 is defined in an upperside of the lower portion 52 of the hand gripper 50 and communicates with the hole 51.

A resilient knob 16 is laterally formed on the upper portion of the side plate 10 located in the recess 12 above the hook member 15 and is received in the hole 51 of the hand gripper 50. A stop block 161 is formed on an underside of the resilient knob 16 and is detachably engaged in the slot 511 of the hand gripper 50.

Figure 6:
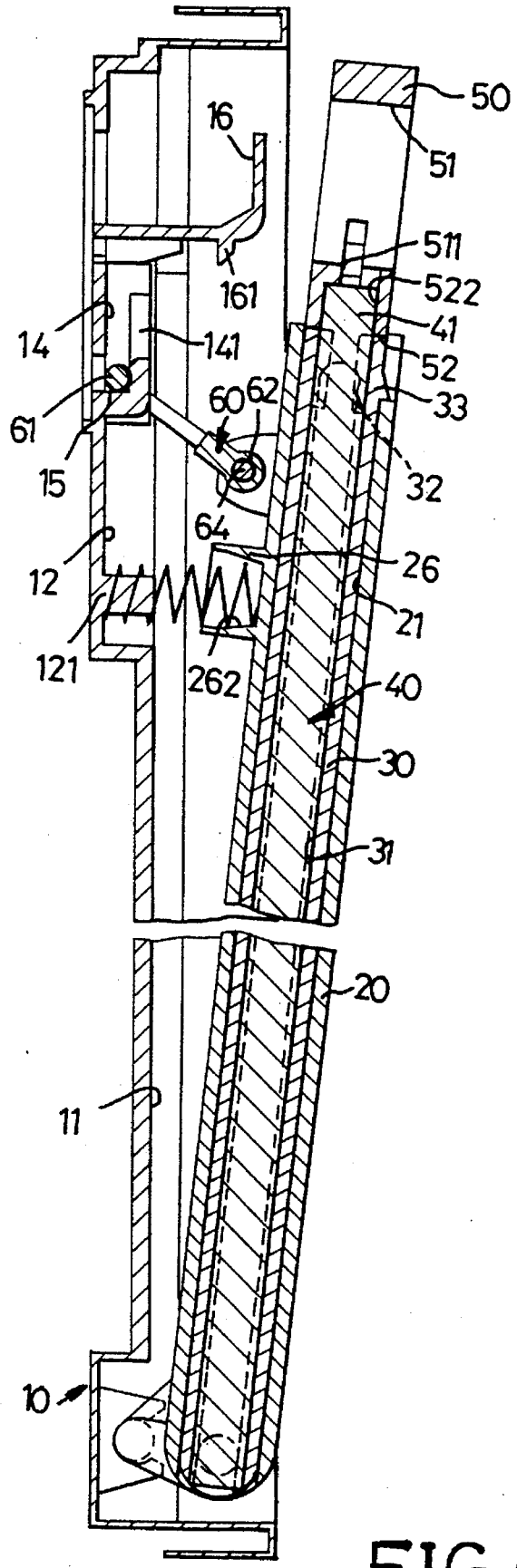
FIG. 6 is an operational view of FIG. 5.

In operation, referring to FIGS. 5 and 6 with reference to FIG. 4, the hand gripper 50 is fixedly attached to the handle 40 which is initially retracted into the inner casing 30 which is in turn retracted into the outer casing 20. The stop block 161 of the resilient knob 16 is initially locked in the slot 511 of the hand gripper 50 as shown in FIG. 5, thereby securing the upper portion of the outer casing 20 is to the side plate 10.

The resilient knob 16 can be urged upwardly, thereby detaching the stop block 161 from the slot 511 such that the lug 26 is forced outwardly relative to the post 121 by means of the biasing member 13 and such that the outer casing 20 is pivoted outwardly relative to the side plate 10 as shown in FIG. 6.

In the meantime, the first axle 62 of the linking member 60 together with the positioning ears 25 is moved outwardly relative to the side plate 10 and the second axle 61 of the linking member 60 is stopped by the two retaining blocks 141 such that the linking member 60 is pivoted relative to the upper portion of the outer casing 20 and the second axle 61 thereof is urged to move downwardly along the two guiding grooves 14 until the second axle 61 reaches the bottom portion of the two retaining blocks 141 as shown in FIG. 6. Preferably, the hook member 15 is provided for further supporting the second axle 61.

Figure 7:
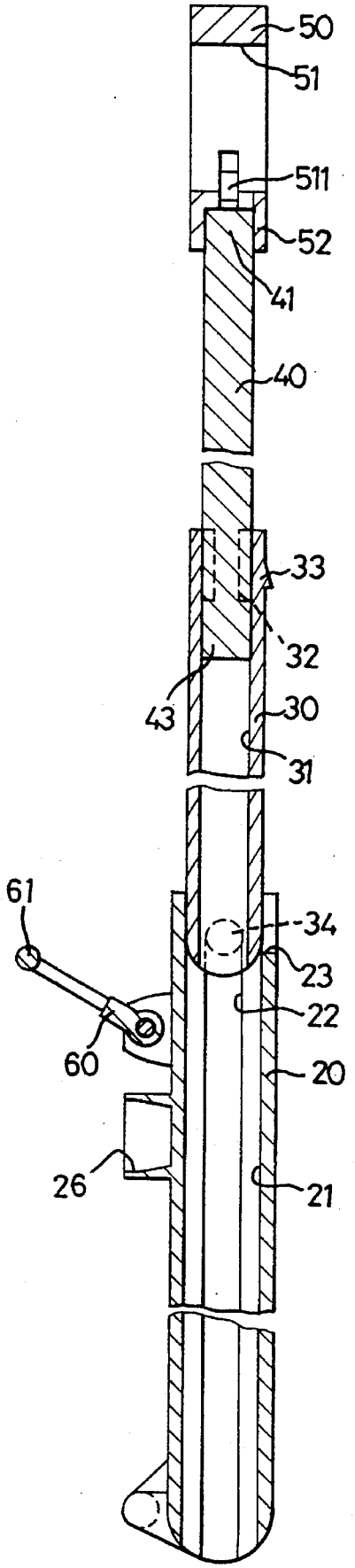
FIG. 7 is a further operational view of FIG. 6.

Then, referring to FIG. 7, the handle 40 can be pulled to move upwardly along the second passage 31 of the inner casing 30 by means of exerting an upward force on the hand gripper 50 until the first flange 43 of the handle 40 is stopped by the second flange 32 of the inner casing 30.

Subsequently, referring to FIGS. 7 and 8, the inner casing 30 together with the handle 40 is further driven to move upwardly in the first passage 21 along the two guiding slots 22 by engagement between the first and second flanges 43 and 32 until each of the two stubs 34 of the inner casing 30 is stopped by the uppermost perimeter of an associated slot 22 as shown in FIG. 7.

Figure 8:
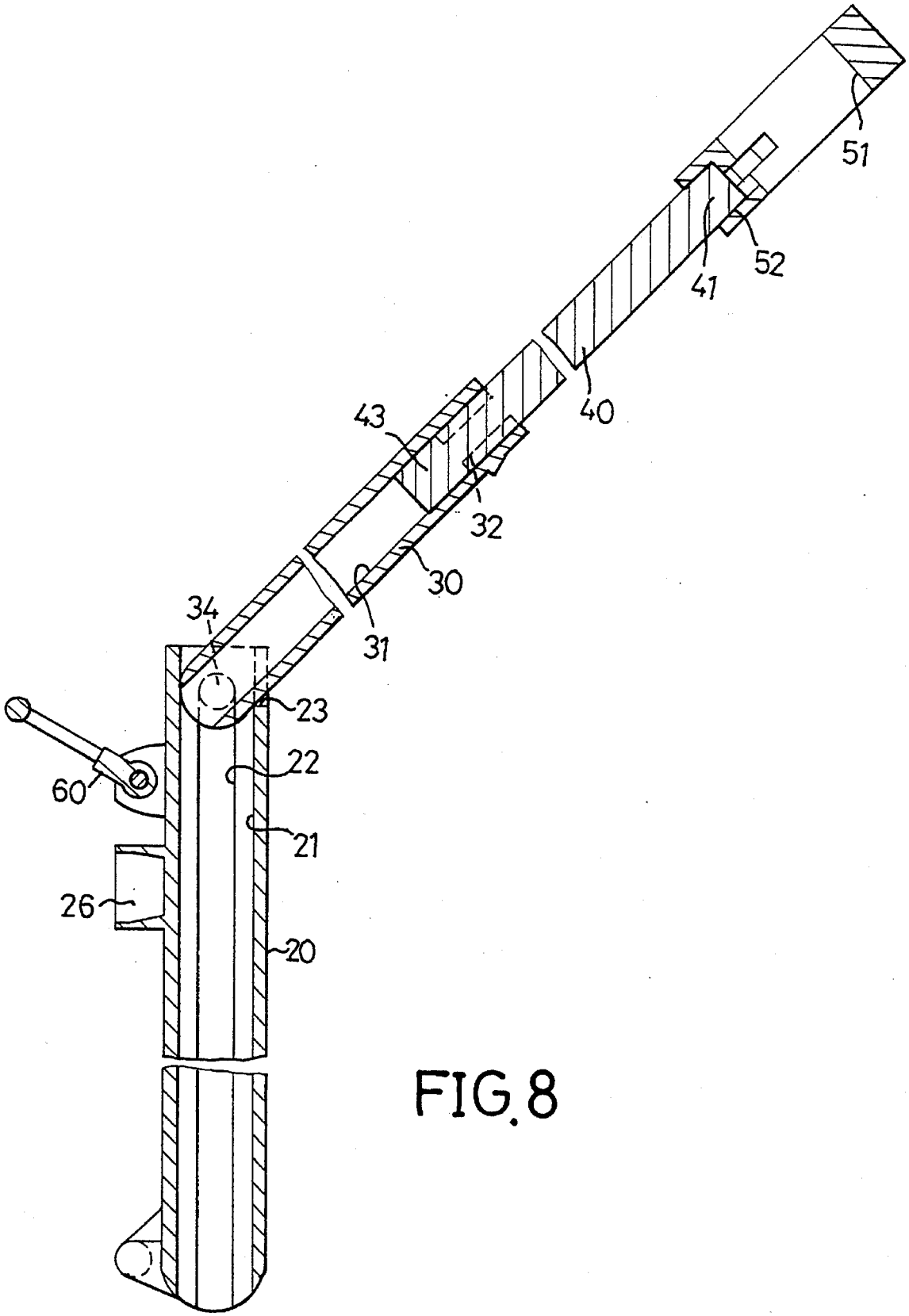
FIG. 8 is a further operational view of FIG. 7.

At the same time, the inner casing 30 can be pivoted outwardly relative to the outer casing 20 about the two stubs 34 until an outer wall of the lower portion of the inner casing 30 is rested on the upper edge 23 of the outer casing 20 as shown in FIG. 8.

Figure 9:
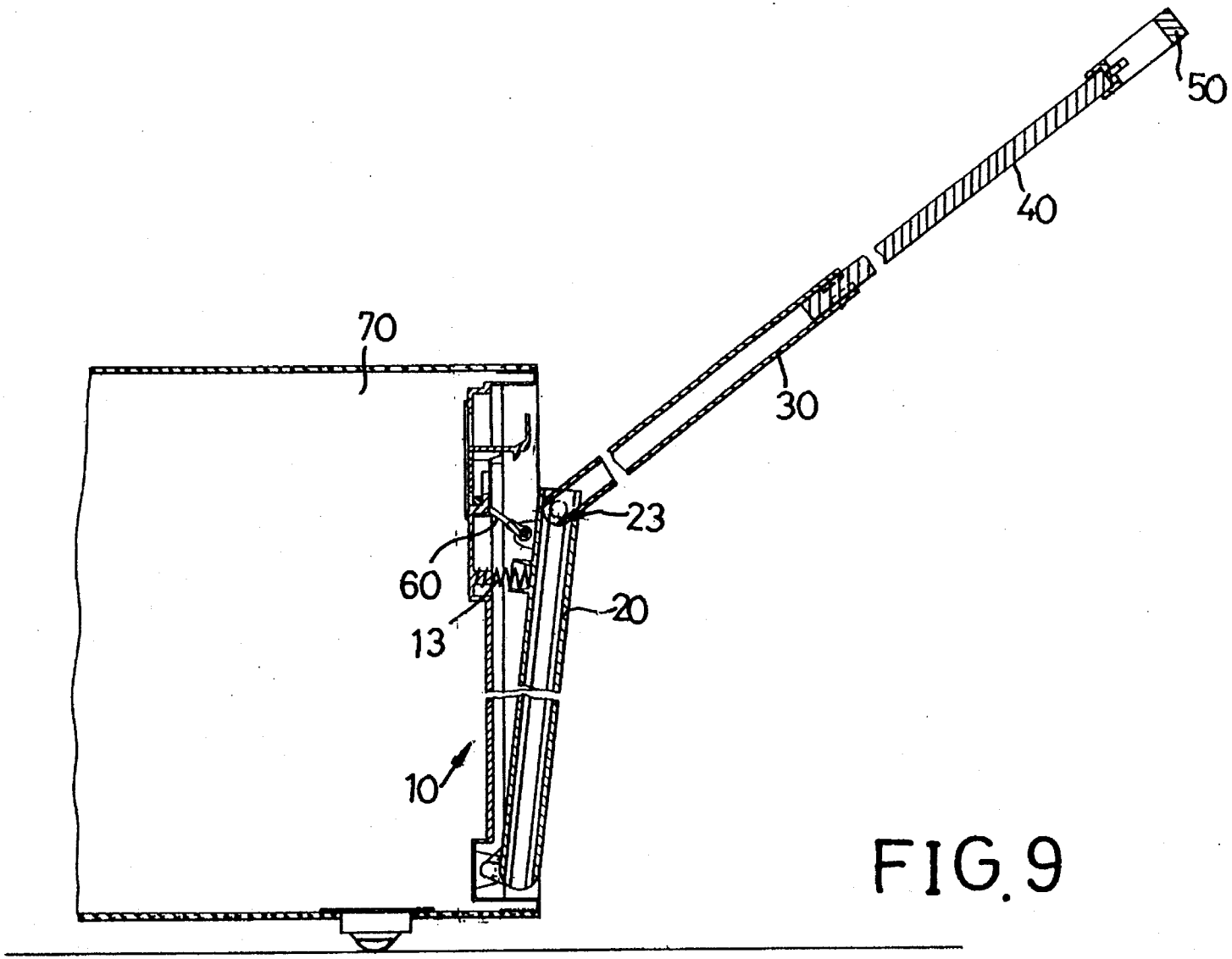
FIG. 9 a side cross-sectional assembly view showing the handle assembly being disposed in a fully expanded status.

The fully expanding status of the handle assembly is shown in FIG. 9. The retractable handle assembly can be folded to the original status as shown in FIG. 1 easily, and the folding action thereof will not be further described.

It should be clear to those skilled in the art that further embodiments of the present invention may be made without departing from the teachings of the present invention.

What is claimed is:

1. A retractable handle assembly for a suitcase (70) which includes a side plate (10) securely mounted thereon and having an upper portion, a mediate portion and a lower portion, said retractable handle assembly comprising:

an elongated outer casing (20) having an upper portion, a mediate portion and a lower portion pivotally mounted to the lower portion of said side plate (10), a first passage (21) longitudinally defined in said outer casing (20), a lug (26) laterally formed on the mediate portion of said outer casing (20) and protruding outwardly therefrom, a chamber (262) transversely defined in said lug (26);

a horizontal post (121) laterally formed on the mediate portion of said side plate (10) and detachably engaged in said chamber (262) of said lug (26);

a biasing member (13) mounted in said chamber (262) and urged between said horizontal post (121) and said lug (26);

two retaining blocks (141) each laterally formed on the upper portion of said side plate (10) and protruding outwardly therefrom, each of said two retaining blocks (141) having a guiding groove (14) vertically defined therein;

a linking member (60) including a first axle (62) pivotally attached to the upper portion of said outer casing (20)

and a second axle (61) having two distal ends each being stopped by a corresponding one of said two retaining blocks (141) and each being slidable in an associated said guiding groove (14);

an elongated inner casing (30) slidably mounted in said first passage (21) of said outer casing (20) and having an upper portion, a second passage (31) longitudinally defined in said inner casing (30);

an elongated handle (40) slidably mounted in said second passage (31) of said inner casing (30) and having an upper end portion (41) extending outward of the upper portion of said inner and outer casings (30) and (20);

a handgrip (50) having a lower portion (52) fixedly attached to the upper end portion (41) of said elongated handle (40), a hole (51) transversely defined through said handgrip (50), a slot (511) defined in the lower portion (52) of said hand gripper (50) and communicating with said hole (51); and a resilient knob (16) laterally formed on the upper portion of said side plate (10) located above said two retaining blocks (141) and received in said hole (51) of said handgrip (50), a stop block (161) formed on an underside of said resilient knob (16) and detachably engaged in said slot (511) of said handgrip (50).

2. The retractable handle assembly in accordance with claim 1, wherein said outer casing (20) includes two longer walls (202) and two shorter walls (204), each of said two shorter walls (204) having an elongated slot (22) longitudinally defined therein and communicating with said first passage (21), two stubs (34) each laterally formed on a lower portion of said inner casing (30) and each slidably mounted in a corresponding one of said two elongated slots (22).

3. The retractable handle assembly in accordance with claim 2, wherein one of said two longer walls (202) includes an upper edge (23) having a level lower than that of an uppermost part of each of said two elongated slots (22), a projection (33) laterally formed on the upper portion of said inner casing (30) and detachably abutting on an upperside of said upper edge (23).

4. The retractable handle assembly in accordance with claim 1, wherein a first flange (43) is formed on a lower end portion of said elongated handle (40), a second flange (32) formed on the upper portion of said inner casing (30) and extending inwardly from a perimeter of said second passage (31) for stopping movement of said first flange (43).

5. The retractable handle assembly in accordance with claim 1, wherein said outer casing (20) has two positioning ears (25) laterally formed thereon each having a bore (250) transversely defined therethrough, said first axle (62) of said linking member (60) mounted between said two positioning ears (25) and having a hole (620) longitudinally defined therethrough which aligns with said two bores (250), a positioning pin (64) extending through said two bores (250) and said hole (620) such that said linking member (60) is pivoted to said outer casing (20) about said first axle (62).

6. The retractable handle assembly in accordance with claim 1, wherein an L-shaped hook member (15) includes a horizontal section formed on the upper portion of said side plate (10) and located between said two retaining blocks (141) and a vertical section extending upwardly.

* * * * *